US008375605B2

(12) United States Patent
Ruhl et al.

(10) Patent No.: US 8,375,605 B2
(45) Date of Patent: Feb. 19, 2013

(54) TRENCHING SYSTEM

(75) Inventors: Michael C. Ruhl, Stillwater, OK (US); David R. Bazzell, Perry, OK (US); Vernon T. Stellman, Stillwater, OK (US); Steven P. Seabolt, Perry, OK (US); Andrew A. Schuermann, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 186 days.

(21) Appl. No.: 12/842,799

(22) Filed: Jul. 23, 2010

(65) Prior Publication Data

US 2011/0016754 A1 Jan. 27, 2011

Related U.S. Application Data

(60) Provisional application No. 61/227,935, filed on Jul. 23, 2009, provisional application No. 61/353,984, filed on Jun. 11, 2010.

(51) Int. Cl.
*E02F 5/08* (2006.01)

(52) U.S. Cl. ..... 37/91; 37/907

(58) Field of Classification Search ..... 37/91, 94, 37/347, 92, 93, 95, 96, 97, 907
See application file for complete search history.

(56) References Cited

U.S. PATENT DOCUMENTS

| | | | | |
|---|---|---|---|---|
| 4,221,505 | A * | 9/1980 | Taylor-Smith | 405/303 |
| 4,326,347 | A | 4/1982 | Ballinger | |
| 4,768,297 | A | 9/1988 | Rivard | |
| 4,794,709 | A | 1/1989 | Rivard | |
| 4,812,078 | A | 3/1989 | Rivard | |
| 4,838,734 | A * | 6/1989 | Pinto | 405/176 |
| 4,958,457 | A | 9/1990 | Doskocil | |
| 5,203,101 | A | 4/1993 | Bryan | |
| 5,315,770 | A * | 5/1994 | Campbell | 37/96 |
| 5,381,616 | A | 1/1995 | Disney | |
| 5,490,339 | A | 2/1996 | Accettola | |
| 5,575,538 | A * | 11/1996 | Gilbert et al. | 299/39.2 |
| 5,873,186 | A | 2/1999 | Yoder et al. | |
| 6,055,750 | A | 5/2000 | Yoder et al. | |
| 6,189,244 | B1 | 2/2001 | Johnson et al. | |
| 6,371,691 | B1 * | 4/2002 | Finzel et al. | 405/157 |
| 6,402,123 | B1 | 6/2002 | Rivard | |
| 6,467,201 | B1 | 10/2002 | McSharry et al. | |
| 6,637,978 | B1 | 10/2003 | Genta | |
| 6,718,660 | B2 | 4/2004 | Rivard | |
| 6,830,412 | B2 | 12/2004 | Perez | |
| 6,866,448 | B2 * | 3/2005 | Finzel et al. | 405/157 |
| 8,061,344 | B2 * | 11/2011 | Dofher | 125/13.01 |
| 8,157,477 | B2 * | 4/2012 | Horan et al. | 405/183 |
| 2004/0148823 | A1 | 8/2004 | Jurgen | |
| 2009/0007460 | A1 * | 1/2009 | Greenlee et al. | 37/94 |

FOREIGN PATENT DOCUMENTS

FR 2898689 A1 9/2007

* cited by examiner

*Primary Examiner* — Thomas B Will
*Assistant Examiner* — Jamie L McGowan
(74) *Attorney, Agent, or Firm* — Tomlinson Rust McKinstry Grable

(57) ABSTRACT

A system for uncovering and sealing a narrow trench. The system comprises several subsystems, including a work machine, a frame for providing a seal with the surface to be trenched, a saw blade, a vacuum system, a system for placing product, and a resealer. The blade includes rotatable tooth bits, which may be rotated and secured to create a blade for narrower or a wider trench. A removable cover and the blade are easily changeable. A ground engaging surface on the frame is manipulated to maintain a seal with changing ground surfaces. Additionally, the vertical location of the blade within the frame is adjustable to create a deeper or shallower trench.

13 Claims, 7 Drawing Sheets

FIG. 5A
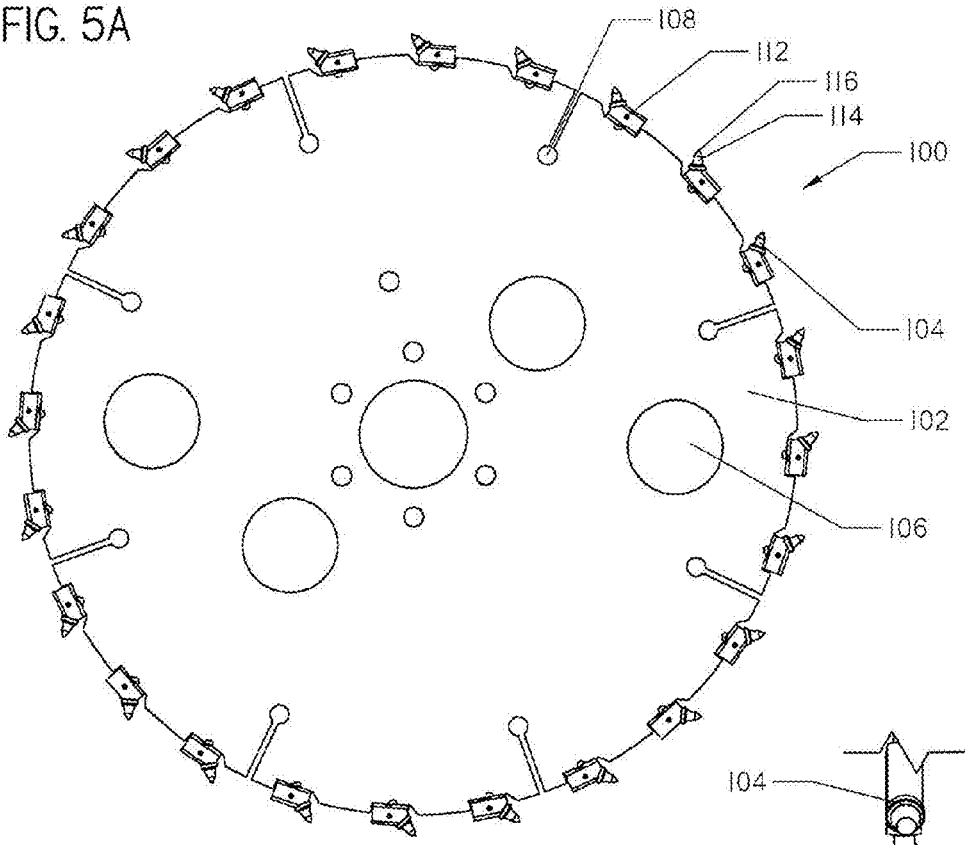
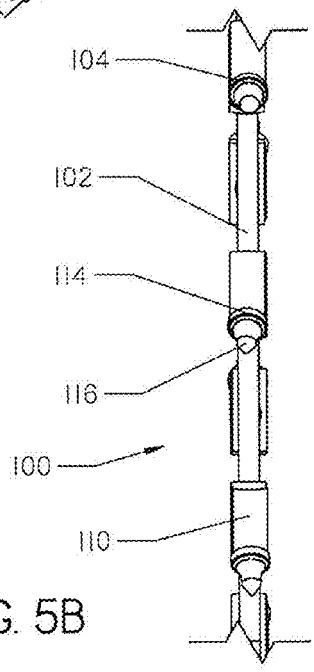
FIG. 5B

FIG. 6A
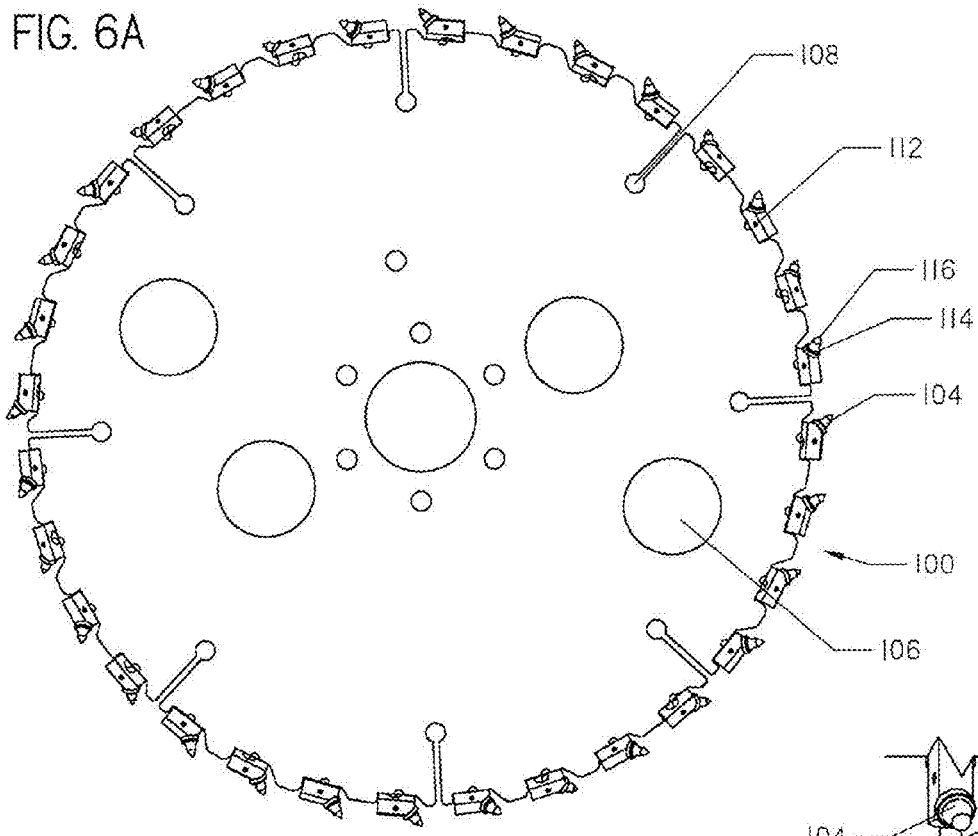
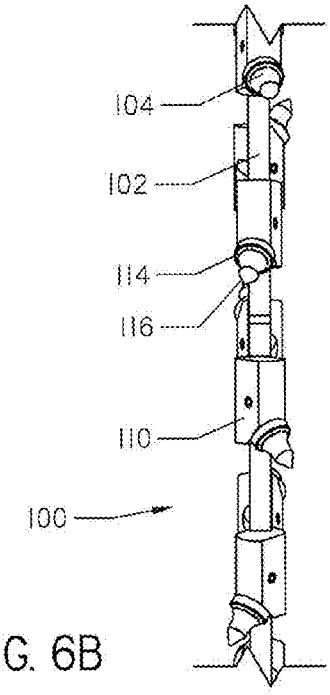
FIG. 6B

TRENCHING SYSTEM

CROSS REFERENCE TO RELATED APPLICATIONS

This application claims priority of U.S. Provisional Patent Application No. 61/227,935, filed Jul. 23, 2009, and U.S. Provisional Patent Application No. 61/353,984, filed Jun. 11, 2010, the contents of which are incorporated fully herein by reference.

FIELD OF THE INVENTION

The present invention relates to the field of outdoor work machines and more particularly to systems for cutting and cleaning a narrow trench.

SUMMARY OF THE INVENTION

The invention is directed to a mobile system for cutting a narrow trench. The system comprises a work machine, and a trenching assembly movably attached to the work machine. The trenching assembly comprises a frame, a removable blade cover, a hub, a blade, and a cylinder assembly. The removable blade cover is attached to the frame. The blade cover and frame define a ground engaging surface and a blade opening. The hub is attachable to the frame such that the vertical position of the hub relative to the frame is moveable. The blade is located substantially within the frame and the blade cover and supported on the hub. The blade extends beyond the blade opening. The cylinder assembly is operatively attached to the work machine and the frame. Operation of the cylinder assembly manipulates an orientation of the ground engaging surface relative to the work machine.

In another embodiment, the invention is directed to a mobile system for cutting a narrow trench. The system comprises a work machine, and a trenching assembly movably attached to the work machine. The trenching assembly comprises a frame, a removable blade cover, a hub, a blade, and a vacuum system. The blade cover is attached to the frame. The blade cover and frame define a ground engaging surface and a blade opening such that the blade opening is substantially sealed when engaged with the ground. The hub is attachable to the frame such that the vertical position of the hub relative to the frame is moveable to alter a cutting depth of the trenching assembly. The blade is located substantially within the frame and the blade cover and supported on the hub. The blade extends beyond the blade opening. The vacuum system is operatively connected to the frame.

In another embodiment, the invention is directed to a trenching assembly. The trenching assembly comprises a disc and a plurality of cutting teeth. The disc defines a circumference and a width. The plurality of cutting teeth are attached to the circumference of the disc portion. At least one of the plurality of teeth is moveable between a radial position and an offset position. At least one of the plurality of teeth extends beyond the width of the disc portion when in the offset position. At least one of the plurality of teeth does not extend beyond the width of the disc portion when in the radial position.

In yet another embodiment, the invention is directed to a method for cutting a narrow trench in a surface. The method comprises providing a saw blade with a plurality of rotatable teeth, choosing a saw blade wherein the plurality of teeth are rotated to achieve a desired trench width, adjusting the blade relative to a frame to achieve a desired trench depth, rotating the saw blade to cut a trench, substantially sealing the surface with a ground engaging surface of the frame and a blade cover, and applying a vacuum within the frame and the blade cover to remove spoils. The saw blade is rotatably and moveably attached to a frame.

BRIEF DESCRIPTION OF THE DRAWINGS

FIG. 5A is a side view of a blade for use with the trench cutter attachment of FIGS. 1-4. The blade shown in FIG. 5A comprises cutting teeth disposed in a radial orientation.

FIG. 5B is a top view of the blade of FIG. 5A.

FIG. 6A is a side view of an alternative blade for use with the trench cutter attachment shown in FIGS. 1-4. The blade of FIG. 6A comprises cutting teeth disposed in an offset orientation.

FIG. 6B is a top view of the blade of FIG. 6A.

DETAILED DESCRIPTION OF THE INVENTION

Figure 1:
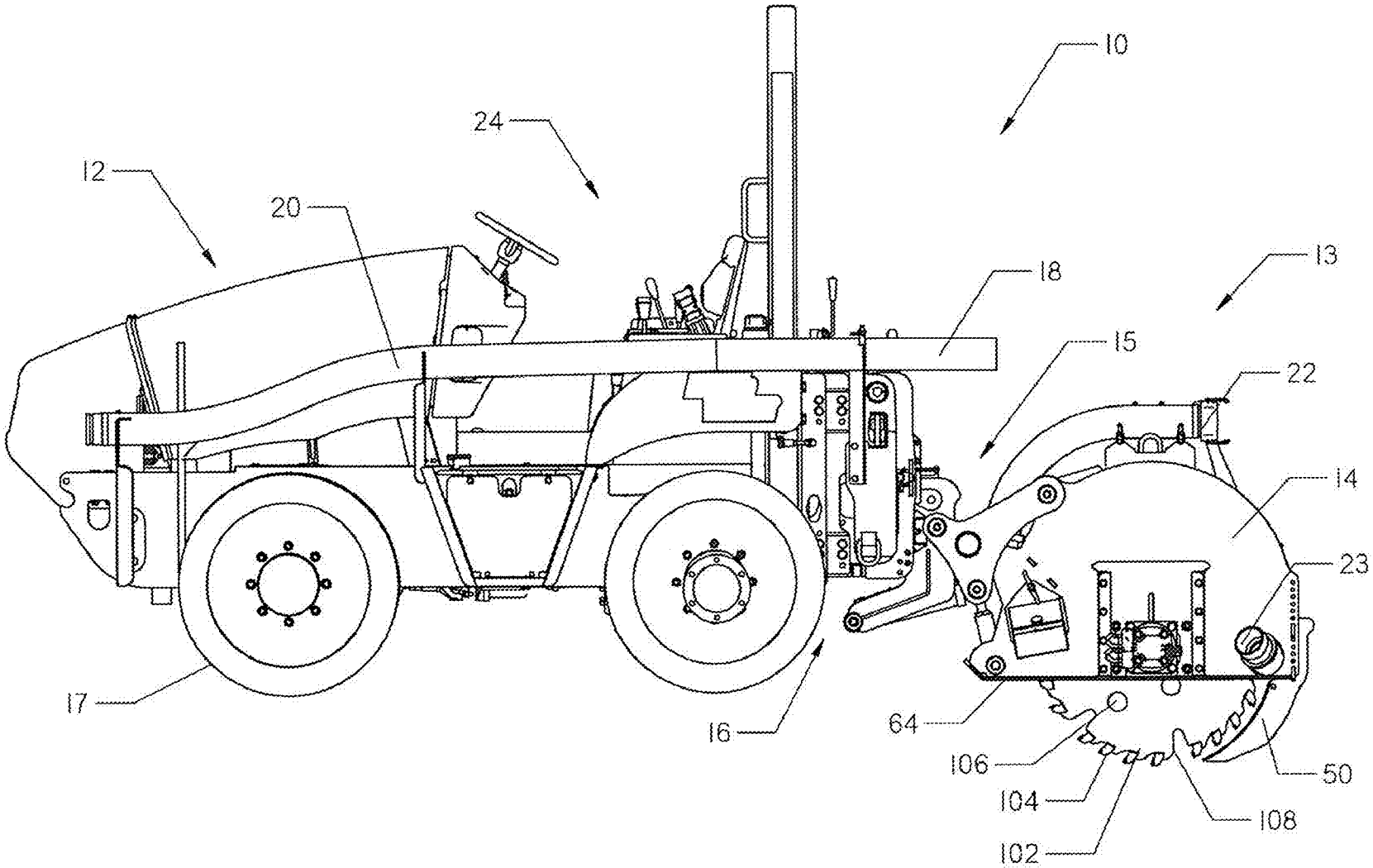
FIG. 1 is a side view of a tractor with a trenching assembly for use with a mobile system for cutting a trench.

Turning now to the drawings in general and FIG. 1 in particular, there is shown a mobile system 10 for cutting a narrow trench of varying depths and widths in a surface. The system 10 comprises a work machine 12 and a trenching assembly 13 attached to the work machine. The trenching assembly 13 comprises a frame 14 and a saw blade 100 rotatably mounted to the frame, which will be described in more detail below. The trenching assembly further comprises a linkage assembly 15 and an attachment frame 16. The work machine 12 may be any common tractor or work vehicle that can support the trenching assembly 13. The work machine 12 shown in FIG. 1 comprises a tractor having wheels 17, however, one skilled in the art will appreciated that a tracked vehicle or a pedestrian work machine may be used with the trenching assembly 13 of the present invention.

The system further comprises a vacuum system 18. As shown, the vacuum system 18 is mounted on the work machine 12 and on the trenching assembly 13 as an integrated single mobile unit. Alternatively, the vacuum system 18 may be a subsystem that can be controlled by the work machine 12 or remote control. The vacuum system 18 comprises a vacuum hose 20, a spoils inlet 22, and a vacuum power unit (not shown). Further, the vacuum system may comprise a cyclonic filtration system (not shown) to filter fine dust and increase power unit life. The spoils inlet 22 is attached to the trenching assembly 13. As shown, a second spoils inlet 23 is also attached to the trenching assembly 13 near a trench cleaner 50. One skilled in the art can appreciate that one or more spoils inlets 22, 23 may be placed on the frame to efficiently remove accumulated spoils from the trenching assembly 13. In FIG. 1, portions of the vacuum hose 20 are not shown, but the hose should be understood to be continuous to each of the spoils inlets 22, 23. An operator station 24 is provided to control operation of the system 10.

Figure 2:
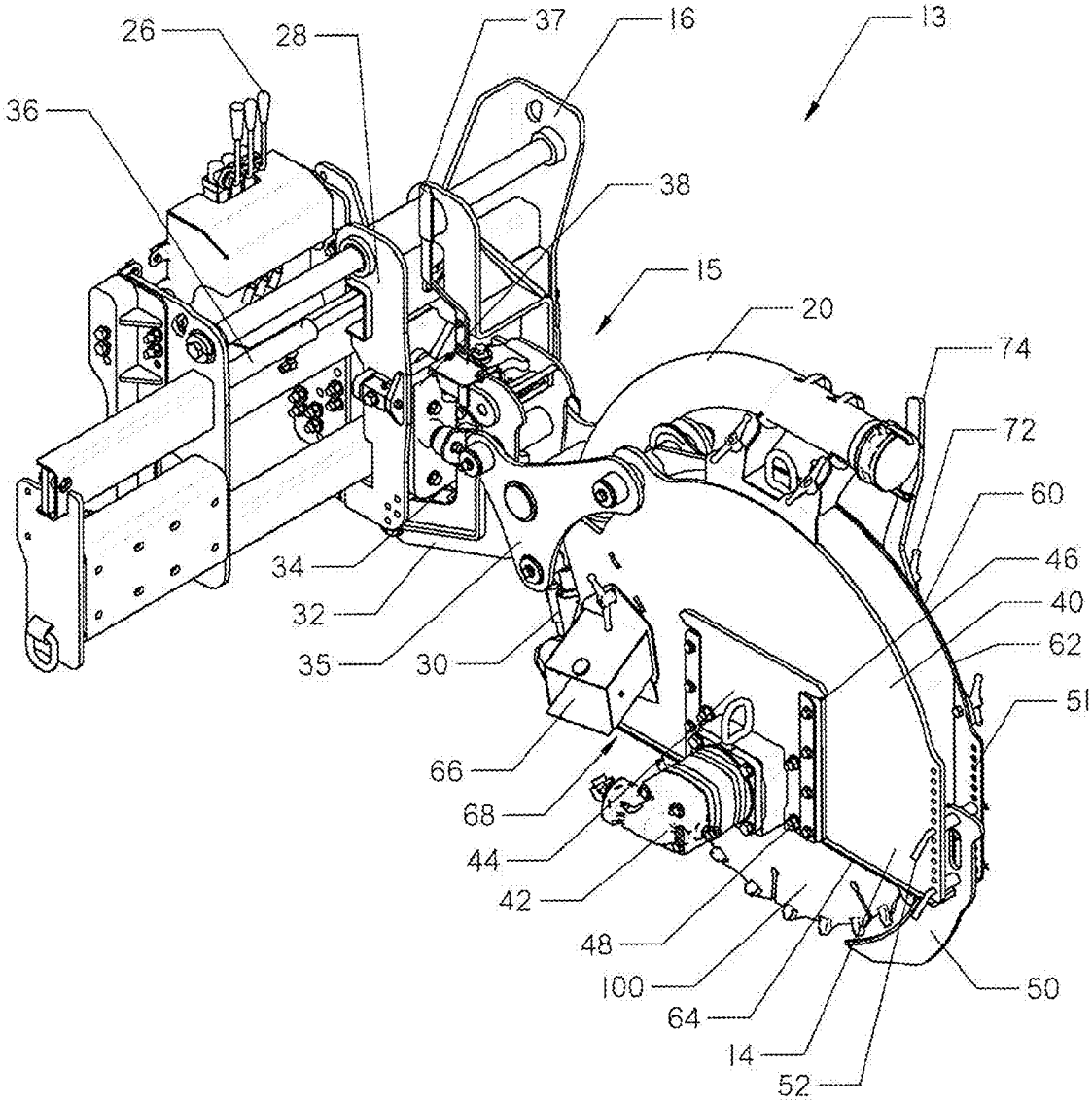
FIG. 2 is a side perspective view of a trench cutter attachment.

With reference now to FIG. 2, another embodiment of the trenching assembly 13 is shown. A control panel 26 is provided to control the trenching assembly 13. The attachment frame 16 is movably supported by the work vehicle 12 (not shown) and adapted to support the linkage assembly 15 and frame 14. The attachment frame 16 comprises a slide frame 28 adapted to traverse the length of the attachment frame. The linkage assembly 15 is adapted to manipulate the frame 14. The linkage assembly 15 comprises a level cylinder 30, a pivot frame 32, a lift cylinder 34, lift arms 35, a traverse cylinder 36, a swing lock 37, and a tilt plate 38. The linkage assembly 15 is mounted on the slide frame 28 such that the linkage assembly 15 may traverse the length of the attachment frame 16 by manipulation of the traverse cylinder 36. As shown, the frame 14 is mounted directly behind the back right tire 17. One skilled in the art could appreciate positioning the frame 14 in other positions relative to the attachment frame 16.

The level cylinder 30 attaches to the frame 14 at a first end and the lift arms 35 at a second end. Extension of the level cylinder 30 manipulates the level of the frame 14 from front to back. The lift cylinder 34 attaches to the pivot frame 32 at a first end and the lift arms 35 at a second end. Extension of the lift cylinder 34 allows for the frame 14 to be raised and lowered. The tilt plate 38 connects the pivot frame 32 to the slide frame 28 of the attachment frame 16. The tilt plate 38 allows the frame 14 to be tilted from side to side to compensate for crowning in a surface. The swing lock 37 secures the frame 14 in a fixed position substantially perpendicular to the attachment frame 16. The swing lock 37 may be unlocked to allow the frame 14 to swing from side to side to saw a curved trench. Thus the linkage assembly 15 utilizes cylinders 30, 34, 36 and other devices to manipulate the orientation of the frame 14. The orientation manipulated includes tilt, level, height from the surface, angle relative to the attachment frame 15, and position relative to the attachment frame. One skilled in the art could appreciate that other mechanisms such as additional cylinders and 4-bar linkages could be used to manipulate the orientation of the frame 14.

With continued reference to FIG. 2, the frame comprises a first panel 40, a motor assembly 42, and the motor plate 44. The first panel 40 is attached to the linkage assembly 15 via the lift arms 35 and the level cylinder 30. The first panel 40 provides structural stability needed to carry the blade 100 and motor assembly 42. As will be shown in FIG. 3, the first panel 40 of the frame 14 is adapted to connect to a removable cover 60.

The motor assembly 42 is mounted on the first panel 40. The motor assembly drives the blade 100. The motor assembly will be described in greater detail with reference to FIG. 4, below. With continued reference to FIG. 2, the motor assembly 42 has the capability of turning the blade 100 at variable RPM. The first panel 40 comprises a slot 46 and connection points 48. The motor plate 44 is adapted to be placed into the slot 46 and mounted at several positions on the first panel 40 using the connection points 48. As shown, the connection points 48 comprise bolts and bolt holes. The adjustment of the motor plate 44 changes a vertical position of the motor assembly 42 and blade 100 relative to the trenching assembly 13, and therefore, the maximum depth of the blade 100.

The trenching assembly 13 further comprises a trench cleaner 50 mounted on the frame. Preferably, the trench cleaner 50 is mounted on an end of the frame 14 and adjustable between a variety of depths. In a first position (not shown), the trench cleaner 48 is flipped and stored along the saw housing 62 for when the blade 100 is not being used. In a second position, the trench cleaner 50 is adapted to extend into an exposed trench. A plurality of paired trench cleaner holes 51 and pegs 52 may be utilized to adjust the position and depth of the trench cleaner 50. The trench cleaner 50 is preferably of a width equal to or very slightly smaller than the width of any exposed trench cut by the blade 100.

Figure 3:
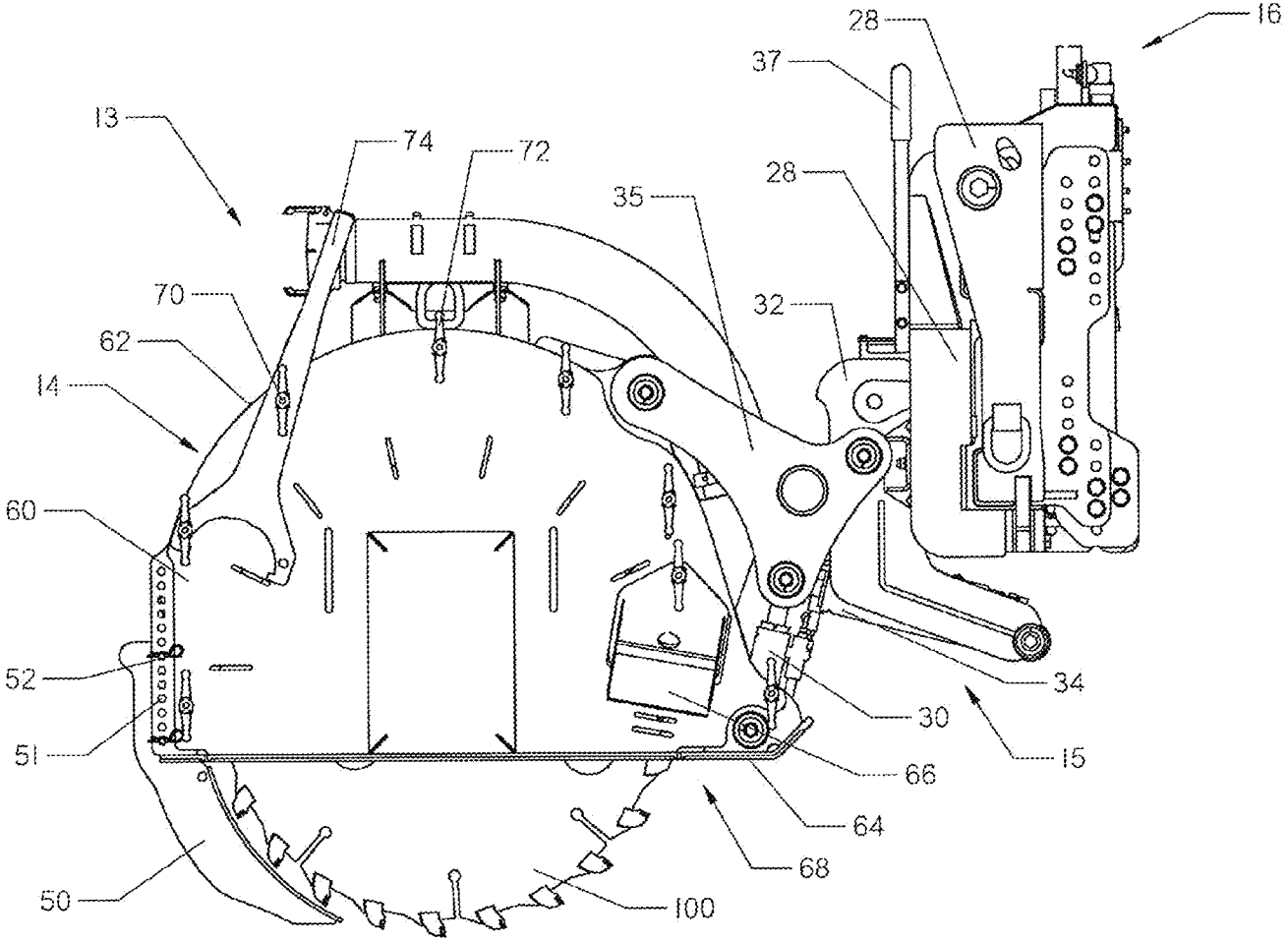
FIG. 3 is a side view of the trench cutter attachment.

With reference now to FIG. 3, the trenching assembly 13 is shown from an opposite side. The frame 14 may be connected to a removable blade cover 60 at the first plate 40. The first panel 40 (FIG. 2) and removable blade cover 60 form a saw housing 62 for surrounding the blade 100. The saw housing 62 comprises a ground engaging surface 64 and at least one spoils chute 66. The spoils chute 66 may be mounted on either side of the saw housing 62 and when opened is adapted to direct spoils away from the uncovered trench.

The ground engaging surface 64 is integral with or mounted on the bottom portion of the saw housing 62. The ground engaging surface 64 defines a perimeter around an opening 68 in the saw housing 62. The ground engaging surface 64 is composed of a durable material suitable for traversing concrete, asphalt, rock, or earth and forming a seal between the ground and the saw housing 62. The linkage assembly 15 generally, and the level cylinder 30 in particular, is connected to the frame 14 such that the opening 68 substantially seals the saw housing 62 to the ground. Preferably, the level cylinder 30 and the ground engaging surface 64 create downpressure proximate a path of the blade 100.

The frame 14 blade cover connections 70 mounted on the first panel 40. The blade cover connections 70 connect to corresponding holes on the removable cover 60 provide a quick method for removing the removable blade cover from the frame 14. As shown, the blade cover connections 70 are connected to the removable blade cover 60 by modified wing nuts 72, though alternative methods of removing and connecting the removable blade cover 60 to the frame 14 are envisioned. A wrench 74 for removing the blade 100 is shown mounted on the trenching assembly 13.

Figure 4:
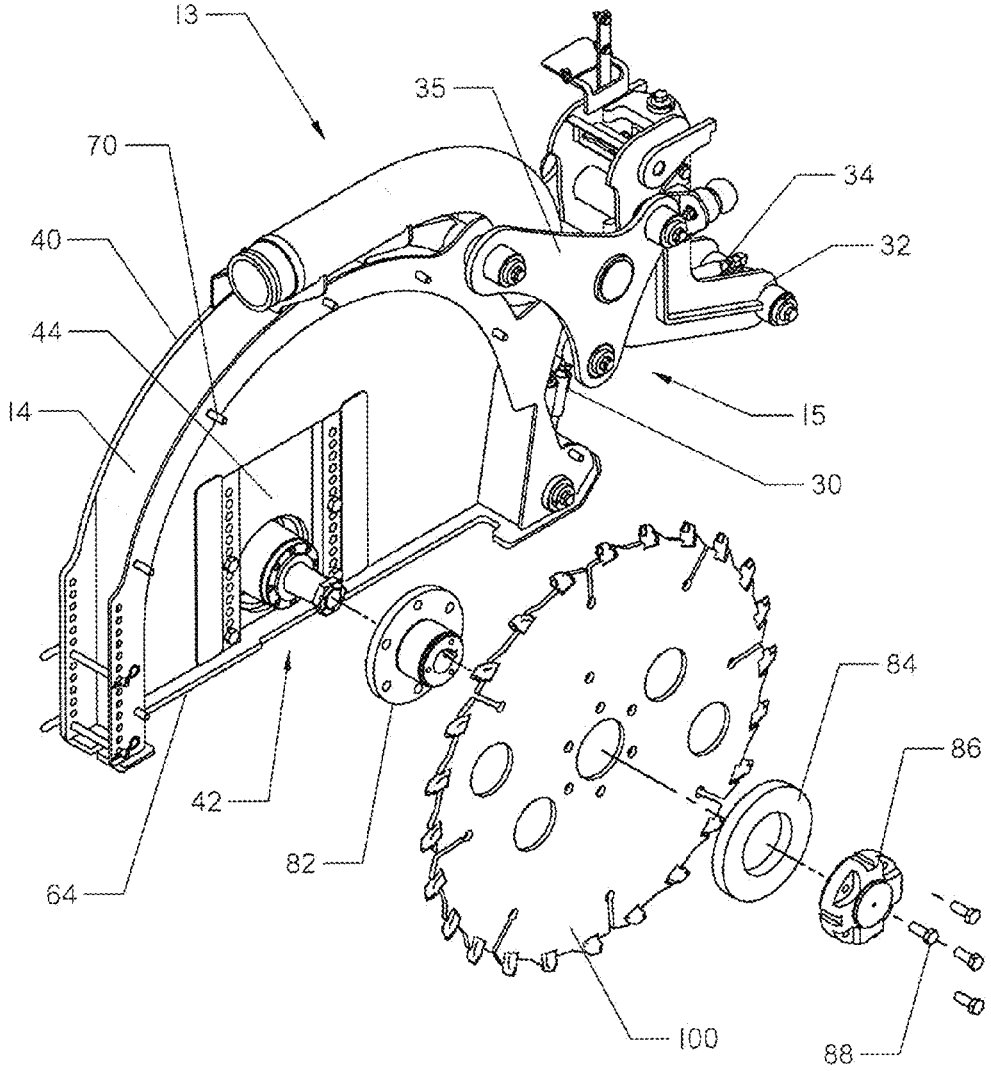
FIG. 4 is an exploded view of a motor assembly for the trench cutter attachment.

With reference now to FIG. 4, the motor assembly 42 of FIG. 2 is shown in exploded view with the removable blade cover 60 removed. The motor assembly 42 is mounted on the first panel 40 supported on the frame 14. The motor assembly 42 comprises a motor 80, threaded hub 82, spacing washer 84, a nut 86 and locking bolts 88. The hub 82 is supported on the frame 14. As shown, the hub 82 is supported on the motor 80 which is supported by the motor plate 44, which is supported by the frame 14. The hub 82 is adapted to fit over a shaft of the motor 80. The saw blade 100 is adapted to slide onto the hub 82 along with a spacing washer 84. The nut 86 is adapted to screw onto the threaded hub 82 to secure the blade 100 and washer 84. Locking bolts 88 are utilized to prevent the nut 86 from coming loose during rotation of the hub 82 and motor 80. Preferably, changing of the blade 100 requires minimal tools to disconnect the blade to the motor assembly 42. The wrench 74 is adapted to quickly remove and replace components of the motor assembly 42. One skilled in the art will appreciate that the wing nuts 72 and wrench 74 may be utilized to fully remove and replace the blade 100 from the trenching assembly 13. In this way a replacement blade 100 may be utilized without removing the system from the worksite.

As shown in FIG. 1, the vacuum system 18 may be mounted such that at least one vacuum inlet 22, 23 is proximate the trench cleaner 50. The vacuum hose 20 may extend beyond the saw housing 62 and into the trench along with the trench cleaner 50. In this way, loosened spoils in the trench that are between the trench walls, trench cleaner 50 and blade 100 are directly removed from the trench.

The blade 100 will be discussed in more detail. The blade 100 is located substantially within the saw housing 62 and supported on the frame 14. The blade 100 extends beyond the opening 68 in the saw housing 62. The blade 100 comprises a disc portion 102 and a plurality of teeth 104. As shown in FIG. 1, the disc portion 102 is generally circular and uniform, but may comprise openings 106 and cutout portions 108 to decrease the friction, decrease the weight of the blade 100 and further help remove spoils from the trench. During operation, the blade 100 may increase in temperature. The cutout portions 108 may also help to mitigate the effects of thermal expansion of the blade 100. Additionally, a cooling agent such as air, water, or foam may be applied to the blade 100 to prevent thermal expansion. The disc portion 102 defines a circumference and a width, and may contain dimples (not shown) to further reduce drag during rotation of the blade 100.

With reference now to FIG. 5A, a first configuration, or radial position of the blade 100 is shown. The blade 100 comprises the disc portion 102, the teeth 104, at least one bit block 110 and at least one roll pin 112. The bit blocks 110 may be rotated and welded to the disc portion 102 in varying radial positions and roll angles. Each tooth 104 is secured to the bit block 110 by the roll pin 112. The tooth 104 comprises a rotating bit 114 and a tip 116. The position of each tooth 104 is directed by the angle that each bit block 110 is rotated with respect to the disc 102. In the radial position shown in FIG. 5B, the teeth do not breach the plane defined by a width of the disc portion 102. The tip 116 is preferably a durable carbide, diamond, or similar material, and conical in shape. Carbide tips 80 are best suited when the motor 80 is operating at lower RPM. Diamond tips 116 on the bits 114 are best suited when the motor 80 is operating at higher RPM.

With reference now to FIG. 6A, a second configuration, or offset position of the blade 100 is shown. As can be seen in FIG. 6B, each of the plurality of teeth 104 breach the plane defined by the width of the disc portion 102 in one direction or the other. One skilled in the art will appreciate that a trench cut by a blade 100 in the offset position will be wider than a trench cut by the same or similar blade in the radial position. Thus, various offset positions may be utilized to customize the width of a trench desired.

As shown, the teeth 104 are of a modular nature and are detachable to the blade 100. Modular, detachable components are easier to replace and ship when worn.

The system 10 can be used in combination with other trenching techniques. For example, the system 10 may cut through a hard surface, but at too shallow a depth. Thus, other trenching systems, such as a vibratory plow, can follow behind the system to cut the trench and install the product deeper but without excessive wear to the other trenching system.

Figure 7:
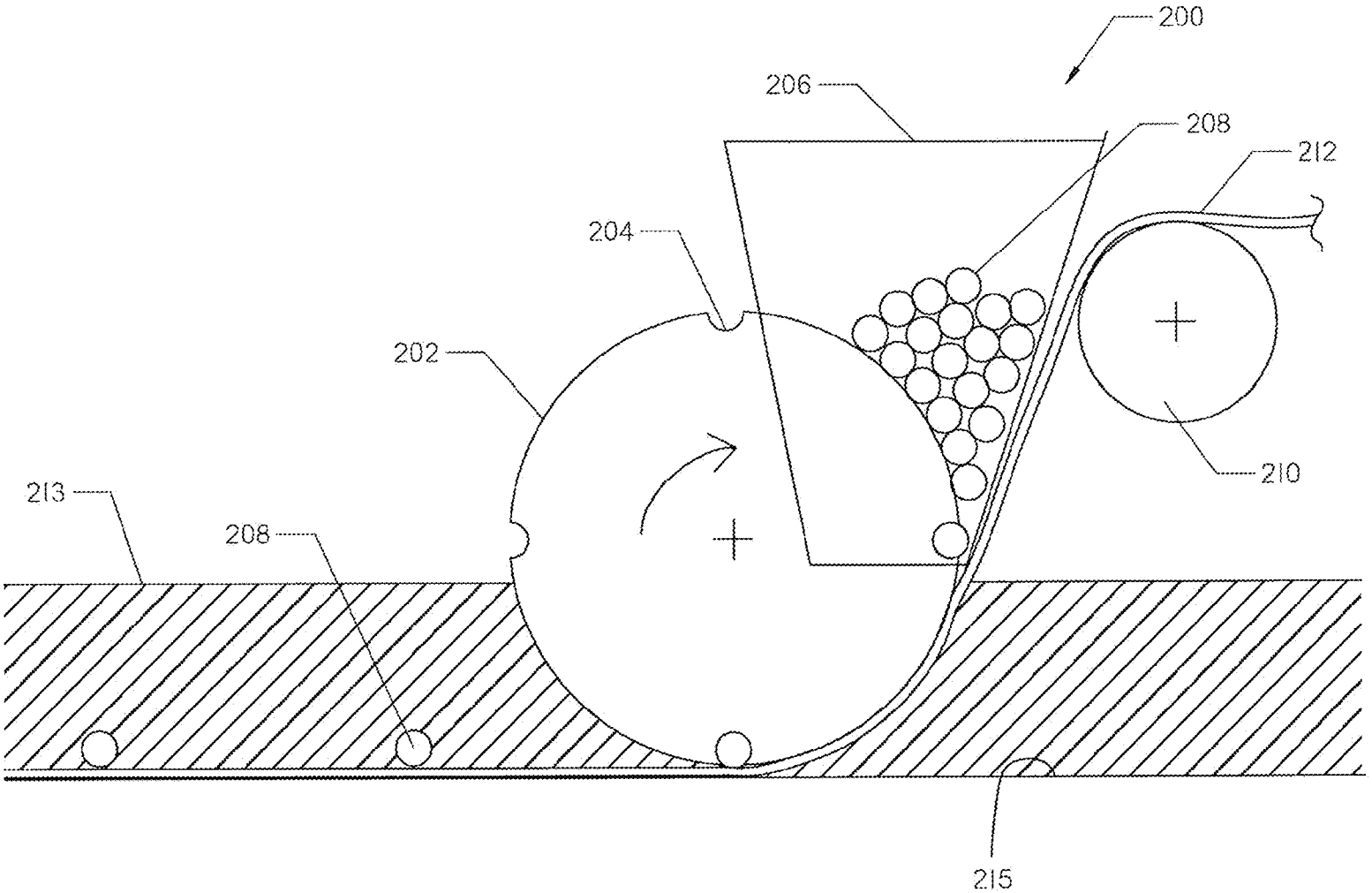
FIG. 7 is a diagrammatic representation of a system for inserting product into a trench cut using the system shown in FIGS. 1 through 6B.

With reference now to FIG. 7, a system 200 for inserting product into the trench 213 is shown. The system 200 comprises a wheel 202 defining at least one notch 204, a hopper 206, at least one deformable ball 208 contained within the hopper, and guides and rollers 210 for feeding a product line 212 into the trench 213. Further, one will understand that the system 200 also comprises a means for moving the system such as a tractor similar to the one shown in FIG. 1. The wheel 202 has a radius larger than the trench depth. As the system 200 is moved along the trench, the notch 204 picks up a ball 208 removed from the hopper 206. The ball 208 is trapped between the wheel 202 and the product 212 and is carried by the wheel to a bottom 215 of the trench. As the wheel 202 continues to roll along the trench, the ball 208 is left in the bottom 215, holding the product 212 in place until the trench can be filled and sealed with a grout or other acceptable material. Alternatively, deformable bulges (not shown) could be molded into the product 212 at fixed intervals to perform the function of the deformable balls 208.

The system 10 may further comprise an apparatus for sealing a trench (not shown). The trench can be sealed with any typical sealant such as grout or concrete. Such a system is sold by K-2 Manufacturing, Inc. under the trade name Grout King™.

One skilled in the art will appreciate that the system 10 comprises several discrete subsystems, such as the vacuum system 18, the system for placing product 200, the apparatus for sealing a trench, etc. Each of these subsystems may be controlled at the operator station 24 located on the work machine 12. Alternatively some or all of the subsystems may be remotely controlled.

In operation, the system 10 is adapted to cut a trench in a surface. The blade 100 is provided and mounted to the trenching assembly 13 at the hub 82. Preferably, a blade 100 is chosen where the plurality of teeth 104 are placed in either the radial or the offset position depending on the desired width of trench. The saw housing 62 is assembled and the hub 82 and blade 100 are raised or lowered by the motor plate 44 to achieve a desired trench depth. The blade 100 is rotated to cut a trench and the at least one cylinder 30, 34, 36 and linkage assembly 15 are adjusted to achieve a substantial seal between the ground engaging surface 64 and the surface being trenched. The vacuum system 18 is activated to remove spoils at the vacuum inlet 22, 23. The trench cleaner 50 provides a channel for the removal of spoils from within the trench.

As work machine 12 moves across the surface, the trenching assembly 13 may be adjusted by linkage assembly 15 and cylinders 30, 34, 36 to maintain the substantial seal between the ground engaging surface 64 and the surface being trenched over uneven terrain. The level cylinder 30 provides downpressure on the surface proximate a path being trenched by the blade 100. The downpressure of the ground engaging surface 64 coupled with the rotation of the blade 100 creates a "scissor" effect when cutting the trench. In this way, the system 10 avoids breakout of the surface, such as asphalt pavement, being trenched.

Product 212 may then be placed within the uncovered trench using the system for inserting product 200. The trench may then be covered by a sealing machine (not shown) trailing the system 10 and sealing the trench with concrete or grout.

Various modifications can be made in the design and operation of the present invention without departing from the spirit thereof. Thus, while the principal preferred construction and modes of operation of the invention have been explained in what is now considered to represent its best embodiments, which have been illustrated and described, it should be understood that the invention may be practiced otherwise than as specifically illustrated and described.

What is claimed is:

1. A mobile system for cutting a narrow trench comprising:
a work machine;
a trenching assembly, movably attached to the work machine, the trenching assembly comprising:
a frame;
a removable blade cover attached to the frame,
wherein the blade cover and frame define a ground engaging surface and a blade opening;
a hub, attachable to the frame such that the vertical position of the hub relative to the frame is moveable;
a blade, located substantially within the frame and the blade cover and supported on the hub, wherein the blade extends beyond the blade opening; and
a cylinder assembly operatively attached to the work machine and the frame wherein operation of the cylinder assembly manipulates an orientation of the ground engaging surface about three axes relative to the work machine, side-to-side tilt and front-to back tilt.

2. The system of claim 1 further comprising a vacuum system operatively connected to the frame.

3. The system of claim 2 further comprising a trench cleaner blade wherein the vacuum system is operatively connected to the frame proximate the trench cleaner blade.

4. A mobile system for cutting a narrow trench comprising:

a work machine;

a trenching assembly movably attached to the work machine comprising:

a frame;

a removable blade cover attached to the frame;

wherein the blade cover and frame define a ground engaging surface and a blade opening such that the blade opening is substantially sealed when engaged with the ground by an orientation of the ground engaging surface;

a cylinder assembly for manipulating the orientation of the ground engaging surface about three axes, side-to-side tilt and front-to-back tilt;

a hub, attachable to the frame such that the vertical position of the hub relative to the frame is moveable to alter a cutting depth of the trenching assembly;

a blade, located substantially within frame and the blade cover and supported on the hub, wherein the blade extends beyond the blade opening; and a vacuum system operatively connected to the frame.

5. The mobile system of claim 4 further comprising a means for placing a product into the narrow trench.

6. The mobile system of claim 4 further comprising a means for sealing the narrow trench after placing the product in the narrow trench.

7. The mobile system of claim 6 wherein the means for sealing the narrow trench comprises a caulking apparatus.

8. The mobile system of claim 4 further comprising a cylinder wherein the cylinder is adapted to exert downpressure on the ground at the ground engaging surface.

9. A method for cutting a narrow trench in a surface comprising:

providing a saw blade with a plurality of rotatable teeth wherein the saw blade is rotatably and moveably attached to a frame;

choosing a saw blade wherein the plurality of teeth are rotated to achieve a desired trench width;

adjusting the saw blade relative to the frame to achieve a desired trench depth;

rotating the saw blade to cut a trench;

substantially sealing the surface by tilting a ground engaging surface of the frame and a blade cover front-to-back and side-to-side and translating the ground engaging surface about three axes; and applying a vacuum within the frame and the blade cover to remove spoils.

10. The method of claim 9 wherein the vacuum is supplied by an externally mounted vacuum system.

11. The method of claim 10 further comprising the step of inserting a product into the uncovered trench.

12. The method of claim 11 further comprising the step of sealing the uncovered trench.

13. The method of claim 9 further comprising the step of exerting a downforce on the ground at the ground engaging surface during rotation of the saw blade.

* * * * *